United States Patent [19]

Campbell

[11] Patent Number: 4,666,162

[45] Date of Patent: May 19, 1987

[54] CONSTRUCTION GAME APPARATUS

[76] Inventor: Lawrence J. Campbell, Box 845, Kaslo, British Columbia, Canada, V0G 1M0

[21] Appl. No.: 802,598

[22] Filed: Nov. 27, 1985

[51] Int. Cl.[4] ..... A63F 3/00; A63F 9/06

[52] U.S. Cl. ..... 273/249; 273/276; 273/153 P; 273/256; 273/241

[58] Field of Search ..... 273/276, 153 P, 157 R, 273/241, 249

[56] References Cited

U.S. PATENT DOCUMENTS

| | | | |
|---|---|---|---|
| 1,578,225 | 3/1926 | White | 434/238 |
| 2,039,097 | 4/1936 | Malm | 211/1 |
| 3,649,018 | 3/1972 | Beam | 273/386 |
| 3,706,456 | 12/1972 | Sesti et al. | 273/276 |
| 4,133,538 | 1/1979 | Ambrose | 273/276 |
| 4,147,359 | 4/1979 | King | 273/241 |
| 4,341,386 | 7/1982 | Kleva | 273/239 |

FOREIGN PATENT DOCUMENTS

| | | | |
|---|---|---|---|
| 378262 | 8/1932 | United Kingdom | 273/276 |
| 2049441 | 12/1980 | United Kingdom | 273/276 |

*Primary Examiner*—Richard C. Pinkham
*Assistant Examiner*—Benjamin Layno
*Attorney, Agent, or Firm*—Wells, St. John & Roberts

[57] ABSTRACT

A game apparatus includes a horizontal playing surface divided into individual playing areas by vertical intersecting walls. Play involves the assembly of geometrical building blocks within each playing area to progressively construct an identical segment of a building structure that is symmetrical across the walls and that includes the walls themselves. The building blocks must be arranged in predetermined layers of diminishing width and length to form a pyramidal structure. The upper wall surfaces are configured as stairways, causing the completed building structure to have the appearance of a Mayan temple. The method of play involves use of chance instructions to regulate assembly of the layers of building blocks. The players alternately add or remove building blocks as instructed until one player has completed a segment of the building structure.

9 Claims, 9 Drawing Figures

CONSTRUCTION GAME APPARATUS

TECHNICAL FIELD

The present invention relates to board games, particularly to an improved board game apparatus and method in which individual players construct identical segments of a common building structure. The construction sequence is governed by chance.

BACKGROUND OF THE INVENTION

This disclosure relates to a table game playable by two or more players who compete to first assemble predesigned segments of a common building structure by utilizing geometrically-shaped building blocks in a sequence determined by chance. It combines the creativity of a building construction game with chance aspects of board games where playing pieces are randomly moved about a path provided with instruction legends. The game requires a balance between chance and skill. While chance is used for regulating the opportunities of a player to construct an assigned building segment, skill is required to selectively place the building blocks in the predetermined order required to accomplish successful stacking of the blocks in a symmetrical pattern across a stationary playing apparatus. The building structure is adequately simple to be assembled by any player without difficulty, and yet presents enough complexity to make the construction process challenging and interesting.

The preferred embodiment of the invention incorporates aspects of Mayan history. The building structure is in the form of a pyramidal temple, including sets of stairs leading to an altar at their summit. Instructional legends, playing pieces, and game currency can be used to carry out the Mayan theme.

BRIEF DESCRIPTION OF THE DRAWINGS

The invention is illustrated in the accompanying drawings, in which.

DETAILED DESCRIPTION OF THE PREFERRED EMBODIMENT

Figure 1:
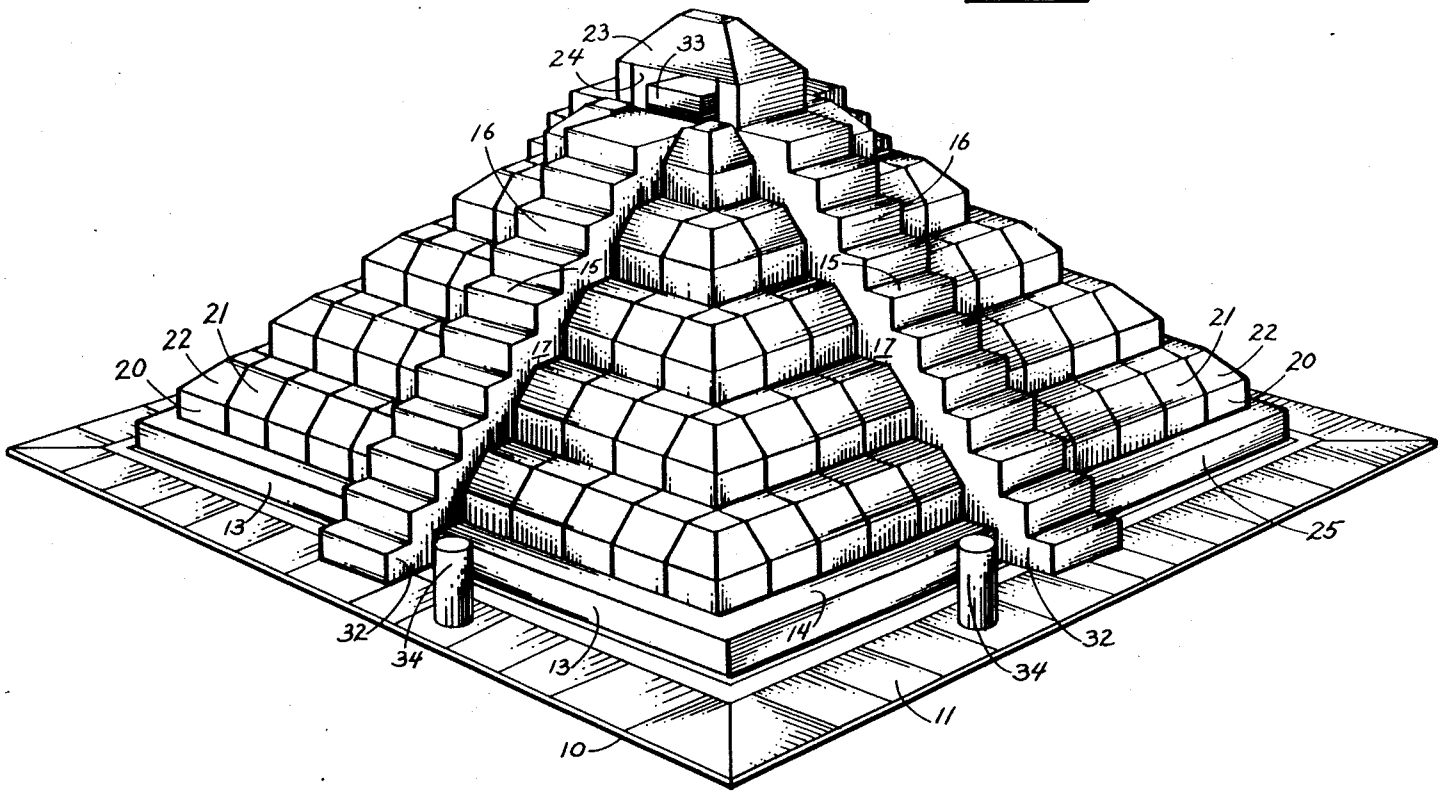
FIG. 1 is a perspective view of the assembled game apparatus.
Figure 2:
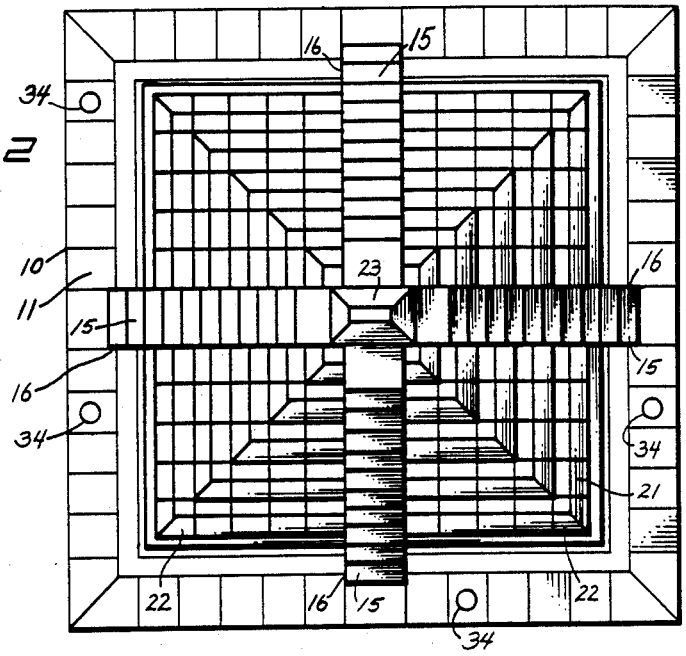
FIG. 2 is a top view of the assembled game apparatus.

In compliance with the constitutional purpose of the Patent Laws "to promote the progress of science and useful arts" (Article 1, Section 8), applicant submits the following disclosure of the invention.

The present game essentially comprises a base adapted to be placed on a table or floor, with individual players positioned at its respective corners. The base comprises a square game board 10 and two rectangular baseboards 13, which rest on the center of game board 10. The baseboards 13 are identical to one another and are placed on game board 10 in side-by-side abutting positions. Their top surfaces comprise a square playing surface 14 on which the building construction steps involved in the game are carried out. The periphery of game board 10 includes a path 11 having printed legends 12 within defined playing spaces, as exemplified by the segment of game board 10 shown in FIG. 6. The printed legends 12 contain instructions for those playing the game.

Figure 5:
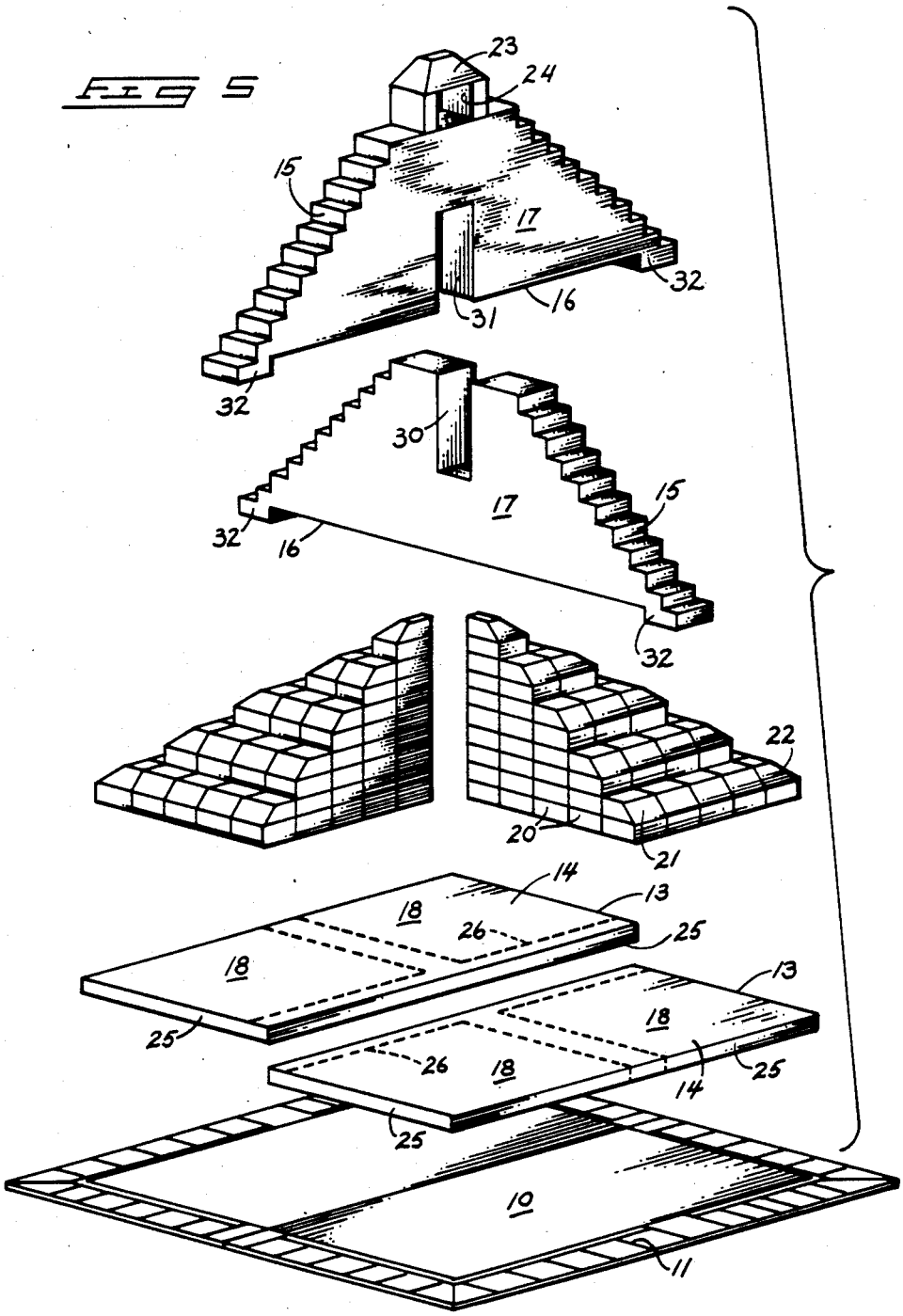
FIG. 5 is an exploded perspective view of the game apparatus.

An upright wall structure is positioned across the playing surface 14. It preferably comprises a pair of perpendicular walls 16 having planar vertical side surfaces 17 extending from the playing surface 14. Walls 16 separate individual playing areas 18 at the four corners of the playing surface 14. Referring to FIG. 5, the outer boundaries of playing surface 14 are the vertical edges 25 of the baseboards 13. The individual playing areas 18 are partially bounded by the vertical edges 25 at the outside corners of the assembled baseboards 13, the inner boundaries of the playing areas 18 being illustrated by dashed lines 26, which coincide with the vertical intersection of side surfaces 17 along walls 16. Each player is assigned a playing area 18 within which that player must attempt to construct a prescribed segment of a building structure that includes the walls 16.

Figure 7:
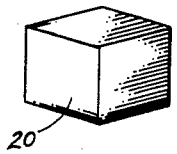
FIGS. 7–9 are perspective views of individual building blocks.
Figure 8:
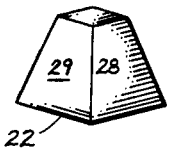
Figure 9:
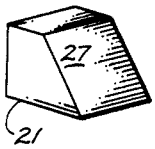

The construction portion of the game apparatus is completed by a plurality of building blocks which include rectangular blocks 20 (FIG. 7), bevel blocks 21 (FIG. 9) and cornerstones 22 (FIG. 8). The blocks in each set are identical to one another. Their size is scaled to the size of the playing areas 18 and complementary walls 16. The rectangular blocks 20 have a square plan configuration. The bevel blocks 21 have an upwardly inclined surface 27 at one side. The cornerstones have upwardly inclined surfaces 28 and 29 at two intersecting sides. Each building block is preferably solid, although they could be constructed in a hollow configuration if molded.

Figure 3:
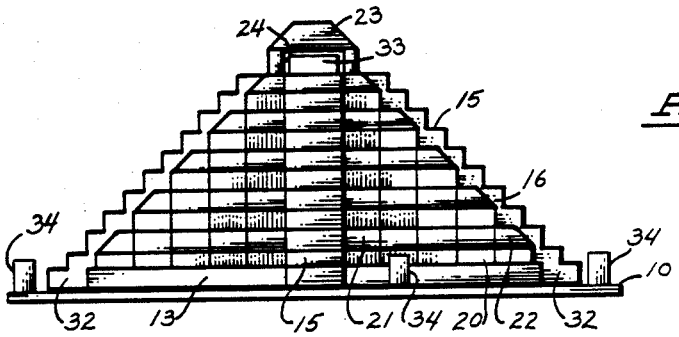
FIG. 3 is a first side elevation view.
Figure 4:
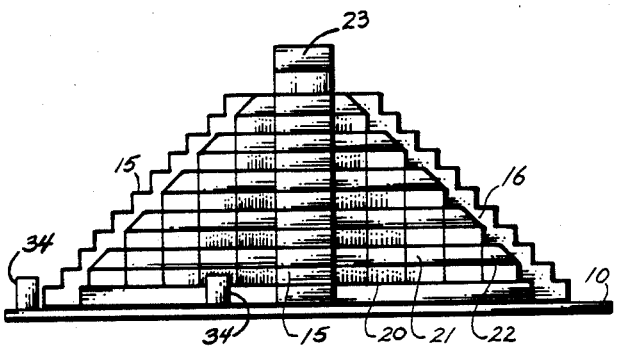
FIG. 4 is a second side elevation view.

In the preferred embodiment, the completed building structure (shown in FIGS. 1 through 4) has the shape of a Mayan Temple. The completed stacks of building blocks within the individual playing areas 18 each constitute an identical segment of a building structure that includes the walls 16. To carry out the Mayan theme, the walls 16 have inclined upper surfaces which are configured as stairways 15 leading upwardly from the edges of playing surface 14 to its center. The height of the stairways 15 is slightly greater than the height of the stacked layers of building blocks adjacent to them. The inclined pitch of the stairs is equal to the pitch of the stacked layers, as is evident from FIGS. 3 and 4.

The perpendicular walls 16 are preferably formed as two planar wall members having complementary slots 30 and 31 equal in width to the width of the walls 16. The respective slots 30 and 31 open upwardly or downwardly at the center of each wall 16. They enable the walls 16 to be selectively interlocked with one another in perpendicularly intersecting positions.

The lower edges of walls 16 rest directly on the playing surface 14 across the top of the assembled baseboards 13. Each wall 16 also includes projecting outer ends 32 that overlap and engage the outer vertical edges 25 about the assembled baseboards 13. This overlapping engagement of the baseboards 13 by the walls 16 maintains the baseboards 13 in abutment with one another during play of the game.

The walls 16 and baseboards 13 can be readily assembled or disassembled for playing or storage purposes. When disassembled, their elements are planar, and can be efficiently stacked parallel to one another and to the underlying game board 10, which is typically hinged across one center line extending between its side edges.

The wall 16 provided with downwardly open slot 31 also includes a center cap 23 that forms the summit of the completed building structure. An opened shelf 24 formed through the cap 23 serves as a simulation of a Mayan Altar Temple. Shelf 24 is used during play of the game for storage of a deck of instruction cards 33 which contain imprinted legends that govern game play.

In a preferred method for playing the game, two different forms of playing pieces 34 are utilized. For drawing simplicity, the playing pieces 34 are shown as simple cylinders. To carry out the Mayan theme of the game, the playing pieces are preferably configured as statues. One set of playing pieces are termed "Workers", and are moved about the game board 10 sequentially by each player during construction of the building structure segments. A second playing piece, configured to represent an Idol or a Mayan God, is subsequently moved about the game board 10 and stairways 15 in a prescribed pattern to complete play of the game after a player has successfully constructed the segment of the structure assigned to the player.

The play of the game can also include a form of currency, by which players can exercise options to purchase building blocks or optional moves of the playing pieces 34. In the preferred form of the game, this currency is referred to as being a plurality of tokens or pieces referred to as "cacao beans". These pieces (not illustrated) can take any form, including printed forms similar to paper money or currency. They have been included in the game apparatus to provide additional areas of skill application in making decisions with respect to play of the game.

The alternating play by each player is governed by roll of a conventional six-sided die (not shown). The number rolled on the die governs movement of the playing pieces 34 about the game apparatus.

The method of play for the game is set out below in detailed rules. More generally stated, the method comprises the step of assigning to each player a playing area 18 bounded partially by an upright wall 16 positioned across the playing surface 14 and separating each playing area 18 from the playing area of another player. Depending upon the roll of a die and resulting movement of playing pieces 34, chance instructions contained in the legends 12 along path 11 or contained in the deck of cards 33 are directed to each player. These instructions regulate the assembly of successive layers of building blocks 20-22 within the player's assigned playing area. Each player sequentially adds or removes building blocks in the possession of the player to or from predetermined patterns of layers of building blocks within the player's assigned playing area 18 as regulated by the chance instructions. The building blocks must be arranged in prescribed stacks of layers which are symmetrical across the wall 16 and which abut the wall 16 as identical segments of a building structure that includes the wall itself. Play continues by alternately directing chance instructions to each player to regulate the addition or removal of building blocks within the player's assigned playing area 18 until one player has completed a segment of the building structure.

The step of directing chance instructions to each player is preferably carried out by placement of a playing piece 34 on the path 11 arranged about the periphery of the playing surface 14. The path 11 includes printed legends 12 containing instructions for those playing the game. After rolling of a die, each player sequentially moves a playing piece 34 about path 11 as governed by the die and reads the printed legend 12 along path 11 on which the playing piece 34 rests. While chance instructions could be directed to each player in many other ways, the movement of playing pieces 34 adds interest to the conduct of the game and assures completely random selection of repetitive instructions with which each player will readily become familiar.

Elements of skill are introduced into the conduct of the game by options available to each player with respect to purchase of building blocks, pruchase of instruction cards, selection of playing pieces to be moved, and the order of assembling the various building blocks in the prescribed layers required to complete a segment of the building structure. The method of playing the game can therefore be developed to appeal to players of almost any age and skill level.

The individual building blocks are adapted to be stacked within the individual playing areas 18 in a completed building structure which is pyramidal in shape. This structure, illustrated in FIGS. 1 through 4, has horizontal outer rows of bevel blocks 21 and upright outer rows of cornerstones 22. The blocks are stacked in horizontal layers having progressively decreasing length and width from the bottom of each stack to its top. In the preferred form of the invention, each stack includes a plurality of paired layers in which the lower layer of each pair is comprised only of one or more rectangular blocks and the upper layer of each pair is comprised of a cornerstone that either abuts the vertical side surfaces 17 of walls 16 or abuts bevel blocks 21 surrounding interior rectangular blocks 20. Each layer of building blocks in the assembly is a solid layer with no structural gaps being permitted between the building blocks, the walls 16, and the underlying playing surface 14.

Figure 6:
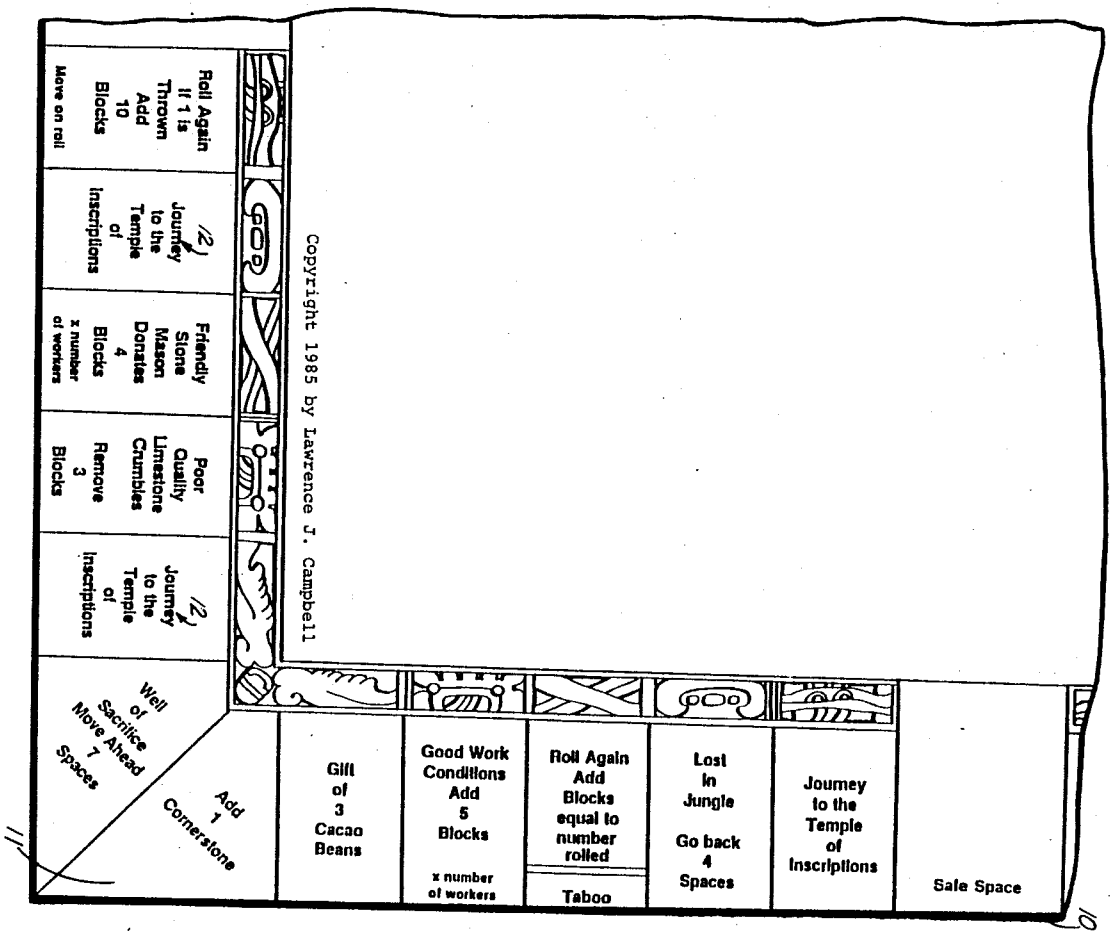
FIG. 6 is a plan view of one portion of the game board.

The segment of path 11 shown in FIG. 6 includes instructional legends 12 related to the specific rules of play which follow. The path segment is repeated about the board in a continuous pattern.

RULES OF PLAY FOR 2, 3, 4 PLAYERS (Copyright 1985 by Lawrence J. Campbell)

OBJECT

In play of the game, each player manipulates from one to four Workers in order to construct one section of a 3-dimensional Pyramid. As soon as a player has finished building the 10 levels of the section, he or she must move an Idol, representing one of four Mayan gods, on an Inspection Tour around the base of the building-block structure and then up a set of stairs to the Altar at its summit. When one player's Idol reaches the Altar, the Pyramid is dedicated to that particular god or goddess. That player wins the game.

EQUIPMENT

The Game Board 10 provides the foundation for the Pyramid and includes around its edges legends 12 with instructions as to how the player's Worker or Workers will spend one working day. The board contains four identical groups of 13 spaces each. One group is fully illustrated in FIG. 6.

Four identical playing pieces 34 represent traveling Workers. They move freely around the board 10 and work for the player in whose section they are located as that player's turn begins.

The Pyramid consists of two identical baseboards 13 (positioned on the Game Board) 10, two interlocking stairways 16 (which divide the Pyramid into four equal sections) and 440 blocks 20–22. There are 340 regular or rectangular blocks 20 which make up the bulk of the 10 levels; 80 bevel blocks 21, which give every second level its smooth, inclined shape; and 20 cornerstones 22. The 110 blocks that each player needs to complete his or her section of the Pyramid must be earned based on the game board instructions or on the 60 instruction cards in deck 33 or may be purchased using the cacao beans which act as currency. The game comes with 100 pieces which stand for cacao beans and with five storage trays which hold the beans.

Four colored playing pieces 34 also represent four Mayan deities. They begin to move only after a player has completed construction on his or her section of the Pyramid.

Four dice are provided. A player uses one die only to determine the moves of Workers or the Idol, and, in some cases, to calculate the number of blocks to add to the Pyramid.

PREPARATION

Situate the Game Board 10 so that each player is seated at a corner. Place the two baseboards 13 within the inner boundary lines marked on the Game Board. They will be held together by the stairways 16.

The stairways are interlocked and are positioned so that the first step of each stairway is on one of the four Safe Spaces.

The instruction cards in deck 33 are shuffled and placed face down inside the shelf 24, referred to as the Altar Temple. The four Workers are then placed on each of the four Safe Spaces. (Slightly different set-up procedures apply when less than four people play). Each player controls the 13 spaces on the Board from and including the Safe Space on his or her left. Each player also receives an Idol whose color corresponds to that of his or her Safe Space. The Idol will not be played until the player's section of the Pyramid is complete.

In addition, each player receives a tray containing 15 cacao beans and one die.

The blocks 20–22 are not distributed until they are earned by the players.

START: THE WORKING DAY

Players begin by each rolling one die. The player with the lowest number is appointed Quarry Master and will be responsible for the giving and collecting of blocks and cacao beans. As payment for these duties, the Quarry Master receives 10 regular blocks before play commences.

The player with the highest number begins a working day first. Before rolling the die, the player may spend cacao beans. (See *CACAO BEANS*). Whether the player has spent cacao beans or not, he or she then rolls the die, moves the Worker clockwise the appropriate number of spaces along path 11, and follows the legend 12 or instructions on the square on which the Worker has landed.

If the Worker lands on the space marked *Journey to the Temple of Inscriptions,* the player must draw the top card from the deck 33 or pile of cards in the Altar Temple and follow its instructions.

If, while still constructing the Pyramid, a player has no Workers on any of his or her 13 spaces, he or she may still purchase blocks, cornerstones or a Worker, or may choose to cause damage to another player's section of the Pyramid. (See *WORKERS*).

When a player has followed the instructions on the board 10 or a card from deck 33, the turn passes to the player on the left. The first player's turn may have resulted in a Worker moving to one of another player's spaces. In that case, the other player gains immediate control of the Worker and follows all appropriate instructions before the regular working day begins for the player whose turn it is next.

If three players are taking part in the game, the Workers bypass the spaces on the unused section of the Board, moving directly to the appropriate space on the next section of Board in use. When the dice are rolled to determine who will move first, the player with the highest roll begins the working day with the fourth Worker on his or her Safe Space.

If two people are playing, they each begin the game with two Workers on their Safe Space. They sit opposite and the Workers bypass the two unused sections, passing directly out of one player's section onto the appropriate space of the opponent's section.

If a fifth person wishes to take part, he or she may act as Quarry Master. In this case, no payment is made for these services.

WORKERS

The playing pieces 34 representing the four traveling Workers are identical in shape and color.

Each player begins the game with a minimum of one Worker on his or her Safe Space. (See *START*). At the commencement of a player's turn during the game, he or she may control any number of Workers, from none to all of them. Two or more Workers may rest on the same space at the same time without penalty. A player who controls more than one Worker may move only one during a turn. He or she may move whichever one will result in the greatest advantage—in accumulating either blocks or cacao beans or in retaining control of the Worker.

A player who has one or more Workers at the beginning of a turn, before rolling the die, may choose to purchase either blocks or a cornerstone from the Quarry Master at the following rates: 1 cacao bean buys 2 blocks (regular or bevel); 10 cacao beans buy 1 cornerstone.

A player without a Worker in his or her territory at the beginning of a turn must choose ONLY ONE of the following five options:

1. The player may purchase 2 blocks from the Quarry Master at a cost of 1 cacao bean.
2. The player may purchase 1 cornerstone from the Quarry Master at a cost of 10 cacao beans.
3. The player may bribe the Quarry Master: The player pays 1 cacao bean and names an opponent. The Quarry Master removes 3 blocks (not cornerstones) from the other player's section of the Pyramid.
4. The player may choose to spend 6 cacao beans to buy a Worker from any other player. He or she may take a Worker from anywhere on the Board except a Safe Space. The player who loses the Worker receives the 6 cacao beans. The player who purchases the Worker places it on his or her Safe Space, rolls the die and takes a regular turn.
5. The player may choose to forfeit a turn only if he or she cannot afford to buy blocks, cornerstones or a Worker. Similarly, a player may forfeit a turn if he or she has all the required blocks but cannot afford a cornerstone or Worker.

Players without Workers or cacao beans forfeit their turns until a Worker lands in their territory.

Once a player has finished constructing the Pyramid section, he or she begins moving the playing piece 34 representing an appropriately-colored Idol. Workers in the completed section move to the other players' Safe Spaces. The Workers are distributed, one per player, clockwise around the Board. The remaining players' Workers bypass completed sections of the Pyramid, moving directly to the appropriate space on the next section of Board in use. When all players have completed their sections of the Pyramid, the Workers are removed from the Game Board.

BLOCKS AND CORNERSTONES

A player constructs the Pyramid section by completing 10 layers of blocks, with each successive layer smaller than the one below. Every second layer includes an edge of bevel blocks 21 and a cornerstone 22.

Blocks 20, 21 and cornerstones 22 may be purchased from the Quarry Master or received as a result of instructions on a card or a space. They may not be exchanged between players.

Some of a player's blocks may be removed during the construction period but not after the player has completed all 10 levels (with the 5 cornerstones in place).

Blocks may be removed as a result of:

1. Another player paying the Quarry master 1 cacao bean in exchange for the opportunity to have 3 of an opponent's blocks returned to the Quarry.
2. One player's Idol landing on a space occupied by another player's Worker or Workers. (Workers on Safe Spaces are unaffected by an Idol). The Quarry Master will remove blocks equal to 3 times the number of Workers on the space.
3. Instructions on cards or spaces.

If a player has all necessary regular and bevel blocks and receives additional blocks as a result of instructions, he or she may sell them to the Quarry Master at the following rate: 2 blocks may be sold for 1 cacao bean.

A player may not receive more than 5 cornerstones. After acquiring all necessary cornerstones, a player ignores instructions on cards or spaces which direct him or her to receive cornerstones.

Cornerstones may not be sold or exchanged for blocks or cacao beans.

In the event that only 1 regular or bevel block is required to complete a Pyramid section, it may be purchased for 1 cacao bean.

For a shorter game, players may wish to construct 1 or 2 layers of the Pyramid before commencing play.

For a longer game, players should assume that a bevel block is worth 2 regular blocks. For example, instructions are given indicating a player is to gain or lose 4 blocks, he or she may instead choose to gain or lose 2 bevel blocks.

CACAO BEANS

Cacao beans are the currency of the game and may be used before a player rolls the die to add or remove blocks or to purchase a Worker or a cornerstone.

Each player begins the game with 15 cacao beans and accumulates more in one of 3 ways:

1. According to instructions on cards or spaces.
2. In exchange for a Worker. A player without Workers may pay 6 cacao beans to any other player in order to purchase any Worker (unless the worker is on a Safe Space).
3. By selling unneeded regular and bevel blocks to the Quarry master. (See *BLOCKS* and *CORNERSTONES*).

PLAYING SPACES

The Game Board consists of 4 sets of 13 spaces. Each player controls the Safe Space to his or her right and the 12 spaces to its left. If less than four people are playing, or if less than four players are still constructing their section of the Pyramid, traveling Workers bypass the unused section of Board.

A player loses control of a Worker as soon as it passes out of his or her section.

As soon as a Worker lands on any space, the player who controls that space must follow the instructions on that space.

Idols are unaffected by the instructions governing all spaces except the *Safe Space.*

The *Safe Space* is the colored space at the base of each stairway. Workers and Idols may be neither purchased nor moved by any opponent when on a Safe Space.

There are three spaces marked *Journey to the Temple of Inscriptions.* They direct a player to pick the top card off the pile of cards within deck 33 in the Altar Temple and immediately follow its instructions. Cards are given to the player who controls the *Inscriptions* space no matter which player moved a Worker to the space.

On the way to the Quarry, a Worker may become *Lost in the Jungle* and therefore moves back to the *Inscription* space controlled by the adjacent player. That player receives the card.

A Worker with the opportunity to *Roll Again* will add blocks to the Pyramid section equal to the number thrown. If a player moves a Worker to the *Roll Again-Taboo* space belonging to the next player, the second player rolls the die, adds blocks and then takes a regular turn. A player moving a Worker to his or her own *Roll Again-Taboo* space does not move the Worker after collecting the blocks. The *Roll Again-Taboo* space is also the transfer point for the *Taboo Card* which forces whoever holds it to send his or her Idol around the Board twice. (See *CARDS*).

The *Cacao Bean, Cornerstone* and *Poor Quality Limestone* spaces instruct the Quarry Master to dispense cacao beans or cornerstones or to receive blocks from the player. Once a player has 5 cornerstones in place, he or she may receive no more and simply ignores the *Cornerstone* space.

If a Worker lands on the *Well of Sacrifice,* it moves to the next player's *Inscriptions* space and that player receives a card and begins a turn. The effect of the *Well of Sacrifice* is cancelled by a *Jade Card.* (See *CARDS*).

The *Roll Again-if* 1 *is thrown* . . . space gives a player an opportunity to win 10 blocks and then forces the Worker into the next player's section.

The *Good Work Conditions* and *Friendly Stone Mason* spaces instruct the Quarry Master to release 5 or 4 blocks times the number of Workers under the player's control during the turn.

INSTRUCTION CARDS

A player receives an instruction card from the deck 33 within the Altar Temple only when a Worker lands on an *Inscriptions* space under his or her control. The cards may increase or decrease the productivity of a working day but only with respect to one Worker; that is, numbers of blocks or cacao beans on cards are always fixed and may not be multiplied by the number of Workers.

Two cards have very special properties:

The *Taboo Card* is an evil omen. Any player who receives it must keep it until he or she manipulates a Worker to land on another player's *Roll Again-Taboo* space, at which time it may be passed on to the second player who may attempt to pass it on to the next player in the same manner. No player may pass on the *Taboo* card after he or she has completed the Pyramid section and no player with a complete Pyramid section may be passed the card.

If a player finishes construction on his or her Pyramid section while in possession of the *Taboo* card, his or her Idol must conduct two *Inspection Tours* before climbing to the Altar. (See *IDOLS-INSPECTION TOURS*). A player who holds the *Taboo* card is protected from it if he or she also holds 2 *Jade* cards. Two *Jade* cards cancel the *Taboo* card. The *Taboo,* however, may still be passed on to the next player.

A *Jade Card* protects a player from the effects of the *Well of Sacrifice,* allowing a Worker to remain on that space.

*Jade* cards may not be sold or exchanged and must be discarded after being used.

IDOLS-INSPECTION TOURS

As soon as a player completes his or her Pyramid section, all Workers in that territory are distributed to the other players. The player then places the appropriately-colored Idol on his or her Safe Space. On the next turn, the player will move the Idol.

The Idol's task is to move around the base of the entire Pyramid, inspecting the progress of the Workers. When it returns to its Safe Space, it climbs the 11 stairs to the Altar.

As it moves around the Game Board, the Idol is unaffected by the positions of Workers and by the instructions on cards or spaces. However, if an Idol lands on a space—other than a Safe Space—occupied by another player's Worker or Workers, the Quarry Master will remove that player's blocks equal to 3 times the number of Workers on the space.

If a Worker lands on a space already occupied by an Idol, no blocks are removed.

If an Idol lands on a space—other than a Safe Space—occupied by another Idol, the second one to arrive knocks the first one back to the nearest Safe Space.

While an Idol is climbing its stairway, it is no longer affected by the actions of other Idols. However, if it lands on the third stair, it must go back 9 spaces to the *Well of Sacrifice.* If it lands on the eighth stair, it falls back to its Safe Space and waits until the player's next turn to attempt to climb again.

Once the Idol is near the top of the stairway, a player must throw the exact number required for the Idol to move to the summit of the Pyramid. Otherwise the Idol does not move.

When the Idol reaches the top of the stairway, it is placed upon the Altar Temple and the Pyramid is dedicated to the god or goddess it represents. The player who controls it wins the game.

Other players may continue playing to determine second place and runners-up.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A three-dimensional construction game apparatus, comprising:

a base having a horizontal playing surface;

a pair of centrally intersecting walls positioned across the playing surface, said walls having side surfaces extending from the playing surface to separate individual playing areas thereon, the upper surfaces of each wall being inclined inwardly and upwardly from its outer ends toward its transverse center;

a plurality of building blocks adapted to be stacked within the individual playing areas in solid horizontal layers that abut said side surfaces and which are symmetrical across said walls, the completed stacks of building blocks within the individual playing areas each constituting an identical segment of a pyramidal building structure that includes said walls;

and means for directing sequential placement of building blocks within the individual playing areas as the game progresses.

2. The game apparatus of claim 1 wherein said building blocks comprise:

a set of rectangular blocks having a square plan configuration;

a set of bevel blocks having an upwardly inclined surface at one side; and a set of cornerstones having upwardly inclined surfaces at two intersecting sides.

3. The game apparatus of claim 1 wherein said building blocks comprise:

a set of rectangular blocks having a square plan configuration;

a set of bevel blocks having an upwardly inclined surface at one side; and a set of cornerstones having upwardly inclined surfaces at two intersecting sides;

the building blocks being adapted to be stacked in horizontal layers having progressively decreasing length and width from the bottom of each stack to its top.

4. The game apparatus of claim 1 wherein said building blocks comprise:

a set of rectangular blocks having a square plan configuration;

a set of bevel blocks having an upwardly inclined surface at one side; and a set of cornerstones having upwardly inclined surfaces at two intersecting sides;

the building blocks being adapted to be stacked in horizontal layers having progressively decreasing length and width from the bottom of each stack to its top;

each stack comprising a plurality of paired layers in which the lower layer is comprised only of one or more rectangular blocks and the upper layer is comprised of a cornerstone either abutting said upright side surfaces abutting bevel blocks surrounding rectangular blocks.

5. The game apparatus of claim 1 wherein the inclined upper surfaces of said walls are configured as stairways leading upwardly from the edges of the playing surface to its center, the height of the stairways being slightly greater than the height of the stacked layers adjacent to them and the pitch of the stairs being equal to the pitch of the stacked layers.

6. The game apparatus of claim 1 wherein said playing surface comprises the upper surface of two identical rectangular baseboards placed in side-by-side abutting positions beneath said walls;

said walls having outer ends that overlap and engage outer edge surfaces of said baseboards to maintain them in abutment with one another during play of the game.

7. The game apparatus of claim 1 wherein the walls comprise two planar wall members having complementary slots that open either upwardly or downwardly at their respective centers, whereby the wall members can be selectively interlocked with one another in perpendicularly intersecting positions.

8. The game apparatus of claim 1 wherein the walls comprise two planar wall members having complementary slots that open either upwardly or downwardly at their respective centers, whereby the wall members can be selectively interlocked with one another in perpendicularly intersecting positions;

the wall member having a downwardly open slot also having a central cap at its center, with an open shelf extending through the cap adapted to support a deck of instruction cards.

9. The game apparatus of claim 1 wherein the walls include a central cap at their center;

the inclined upper surfaces of said walls being configured as stairways leading upwardly from the edges of the playing surface to its center, the height of the stairways being slightly greater than the height of the stacked layers adjacent to them and the pitch of the stairs being equal to the pitch of the stacked layers.

* * * * *